United States Patent [19]

Reed et al.

[11] Patent Number: 4,614,926

[45] Date of Patent: Sep. 30, 1986

[54] HIGH-POWER COAXIAL CABLE

[75] Inventors: Elmer E. Reed; Arthur E. Manoly, both of Palos Verdes Peninsula, Calif.

[73] Assignee: Hughes Aircraft Company, Los Angeles, Calif.

[21] Appl. No.: 698,956

[22] Filed: Feb. 6, 1985

[51] Int. Cl.[4] ..... H01P 1/102

[52] U.S. Cl. ..... 333/244; 333/260; 333/33

[58] Field of Search ..... 333/243–245, 333/249, 260; 174/87

[56] References Cited

U.S. PATENT DOCUMENTS

| | | | |
|---|---|---|---|
| 2,459,197 | 1/1949 | Stewart, Jr. | 333/260 X |
| 2,813,144 | 11/1957 | Valach | 333/260 X |
| 3,055,967 | 9/1962 | Bondon | 333/244 X |
| 3,249,901 | 5/1966 | Spinner | 333/244 |
| 3,344,371 | 9/1967 | Sewell | 333/244 |
| 4,543,548 | 9/1985 | Seal et al. | 333/243 |

*Primary Examiner*—Paul Gensler

*Attorney, Agent, or Firm*—Paul M. Coble; A. W. Karambelas

[57] ABSTRACT

A high-power coaxial cable is disclosed comprising an inner conductor, an outer conductor coaxially disposed about and spaced from the inner conductor, and insulating fittings disposed between the inner and outer conductors near opposite ends of the cable to maintain a desired spacing between the inner and outer conductors. The insulating fitting at one end of the cable has a plurality of longitudinal holes therethrough to reduce the dielectric constant and the impedance of the fitting. The fitting is formed in two like sections joined at right angles to one another along a substantially 45° interface, thereby defining a short 90° turn for the inner conductor near the end of the cable. The fitting sections are retained in position by a surrounding mounting block, the opposite ends of which respectively receive a conductive sleeve and an end of the outer coaxial conductor in press-fit relationship.

3 Claims, 5 Drawing Figures

HIGH-POWER COAXIAL CABLE

The Government has rights in this invention pursuant to Contract No. F08635-82-C-002 awarded by the United States Air Force.

BACKGROUND OF THE INVENTION

1. Field of the Invention

This invention relates to coaxial cables, and is particularly concerned with a simple high-power coaxial cable operating at high frequency and of a construction which accommodates substantial rf heating.

2. Description of Related Art

Prior art coaxial cables transmitting high average power, e.g., in excess of 150 watts, from traveling-wave tubes operated at high frequencies, e.g., about 9 to 11 gigahertz, must allow for substantial heat generation due to dissipation of rf energy. With sufficient heating, the insulation employed in the coaxial cable will tend to become displaced and not return to its proper position, which will tend to destroy the 50-ohm characteristic impedance desired to be maintained between the center and outer coaxial conductors. In addition, burning of the insulation and melting of circuit contacts may result.

In one form of prior art coaxial cable, a fluted Teflon insulator with a center hole was employed to maintain the center and outer conductors properly spaced, but such device was ineffective to accommodate a substantial amount of heat. Teflon foam has also been used for this purpose, but it lacks structural integrity.

Further, 90° turns in prior art coaxial cables have generally been made over a large radius. Sharp right angle turns are usually avoided in any rf device because impedance changes and rf heating resulting from such sharp turns are difficult to control effectively.

SUMMARY OF THE INVENTION

It is, therefore, an object of the present invention to provide a low-cost high-power coaxial cable which accommodates a substantial amount of heat during operation.

It is a further object of the invention to provide a coaxial cable having a novel insulating system for maintaining the center and outer coaxial conductors properly spaced while maintaining the proper impedance between them.

It is another object of the invention to provide a coaxial cable that accommodates a sharp right angle turn without the generation of a substantial impedance mismatch.

A coaxial cable according to the invention includes an inner conductor and a tubular outer conductor coaxially disposed about and spaced from the inner conductor such that a predetermined characteristic impedance is provided. First and second insulating fittings are disposed between the inner and outer conductors near the opposite ends of the cable to maintain the desired spacing between the inner and outer conductors. The first fitting has a plurality of longitudinal holes therethrough to reduce the dielectric constant and impedance of the fitting.

Additional objects, advantages, and characteristic features of the present invention will become readily apparent from the following detailed description of a preferred embodiment of the invention when considered in conjunction with the accompanying drawings.

DETAILED DESCRIPTION OF THE INVENTION

Figure 1:
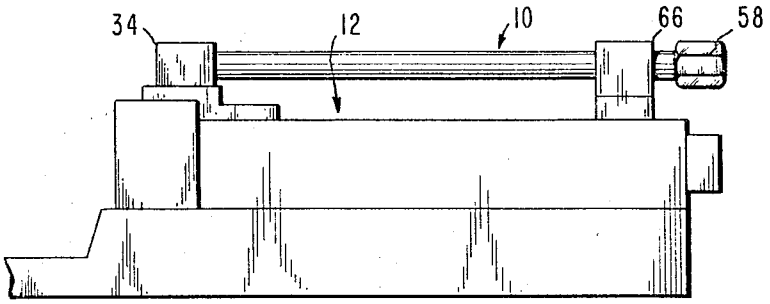
FIG. 1 is an elevational view of a coaxial cable according to the invention, mounted on a suitable support.

Referring in greater detail to the drawings, FIG. 1 illustrates a coaxial cable 10 according to the invention, suitably mounted on a support device 12 which may be a traveling-wave tube from which the coaxial cable 10 transmits a high-power signal.

Figure 3:
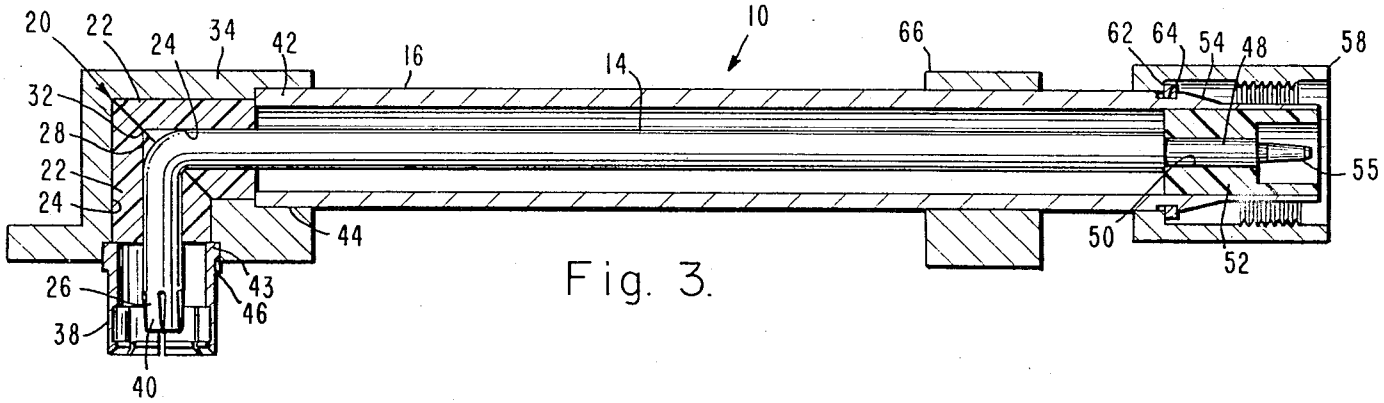
FIG. 3 is a longitudinal sectional view taken along line 3—3 of FIG. 2.

As shown in FIG. 3, the coaxial cable 10 comprises an elongated center conductor 14 of a material of low loss and high thermal conductivity, preferably gold-plated, full hard heat-treated beryllium-copper. An outer tubular ground conductor 16 is coaxially disposed about and spaced from the center conductor 14. The outer conductor 16 may be of a conductive material such as stainless steel.

The center conductor 14 and the outer conductor 16 are spaced sufficiently to maintain approximately 50 ohms impedance between these two conductors. In order to achieve this impedance, the diameter of the center conductor 14 may range from about 0.100 inch to about 0.150 inch, preferably being about 0.125 inch. The outer conductor 16 has an inner diameter ranging from about 0.258 inch to about 0.310 inch, about 0.281 inch being preferred.

A first insulating fitting 20 is provided for receiving and holding one end of the center conductor 14. The fitting 20 comprises two like half-sections 22 of electrically insulating material, such as Teflon, disposed at right angles to each other. Each half-section 22 contains a center hole 24 having the approximate diameter of the center conductor 14 for receiving one end 26 of the center conductor 14. The half-sections 22 are joined at right angles to each other along an interfacing surface 28 disposed at an angle of 45 degrees with respect to the axis of the respective half-section 22. The interfacing surfaces 28 of the half-sections 22 are properly matched in close fitting engagement.

Figure 5:
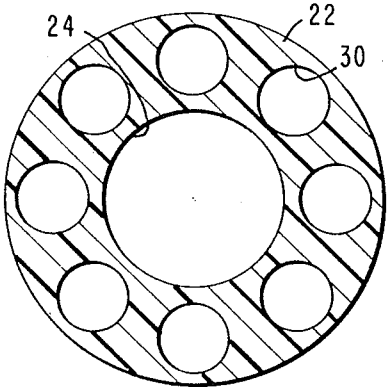
FIG. 5 is a sectional view taken along line 5—5 of FIG. 4.
Figure 4:
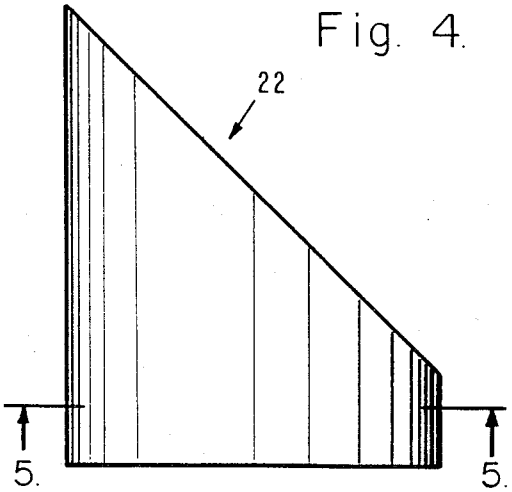
FIG. 4 is an enlarged elevational view of one portion of the insulating fitting at one end of the coaxial cable.

Referring to FIGS. 4 and 5, each half-section 22 further defines a plurality (eight in the exemplary embodiment shown) of longitudinally disposed holes 30, equally circumferentially spaced around the half-section 22. The holes 30 are of smaller diameter than the center hole 24. The holes 30 extend from one end face to the opposite end face of each insulator half-section 22 and function to alter the dielectric constant of the fitting 20. As a specific example for illustrative purposes, since Teflon has a dielectric constant of 2.1 and air a dielectric constant of 1.0, the holes 30 change the dielectric constant of the insulating fitting 20 and reduce the impedance mismatch when the cable 10 is operated at X-band frequencies, i.e., at 9–11 gigahertz.

It should be noted that the insulating fitting 20 and the center hole 24 therein define a sharp right angle turn 32 at interfacing surface 28. As previously noted, such sharp right angle turns have been avoided in prior art coaxial cable devices due to impedance changes and rf heating. However, the construction of the insulating fitting 20, with the air-filled holes 30 reducing the overall dielectric constant and effectively controlling the impedance around the corner, permits such a right angle turn while achieving efficient operation.

Figure 2:
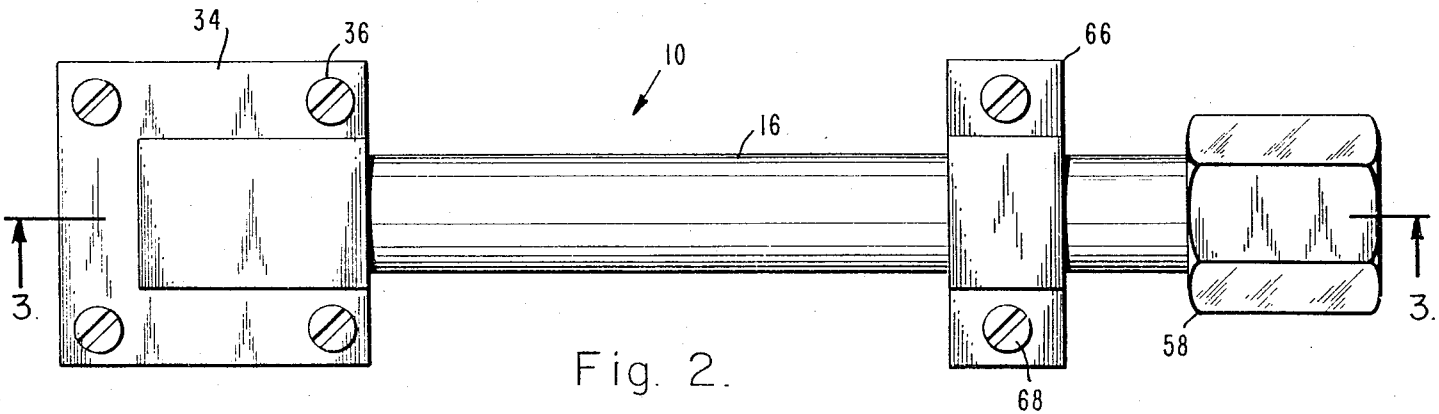
FIG. 2 is a plan view of the device of FIG. 1.

A mounting block 34, which may be of die cast aluminum, is disposed about the half-sections 22 of the insulating fitting 20, the mounting block 34 being fixed to the support device 12 by bolts 36 (FIG. 2). A tubular sleeve 38, preferably of gold-plated, hardened beryllium-copper, is coaxially disposed about the end 26 of the center conductor 14. Conductor end 26 is provided with contact prongs 40 which facilitate electrical connection to a utilization device such as a traveling-wave tube.

End 42 of the outer conductor 16 is press-fit into a counterbore 44 in the adjacent end of the mounting block 34, while the sleeve 38 is similarly press-fit into cylindrical groove 46 in the adjacent end of the block 34, with end 42 of the outer conductor 16 and inner end 43 of the sleeve 38 abutting the adjacent ends of the respective half-sections 22. This arrangement facilitates assembly of the outer conductor 16 and the sleeve 38 in the mounting block 34 in close engaging relationship with the insulating fitting 20.

The opposite end of the center conductor 14 has a reduced diameter portion 48 which is received within a center bore 50 of a tubular insulating fitting 52. The fitting 52 may be of a composition comprised of about 40% boron nitride in Teflon. The fitting 52 is press-fit over the center conductor portion 48 at the adjacent end 54 of the outer conductor 16. It is preferred that the reduced diameter portion 48 of the center conductor 14 have a diameter ranging from about 0.070 inch to about 0.083 inch. The portion 48 of the center conductor 14 carries a pin 55 adapted to fit into a "TNC" interface.

A hexagonal tubular housing 58, of stainless steel, for example, is coaxially disposed about the end region of the outer conductor 16 surrounding the center conductor portion 48 and the pin 55. A snap ring 62 mounted in an annular groove 64 on the outer surface of the conductor 16 locks the housing 58 in position about the outer conductor 16. A clamp 66 is provided around the outer conductor 16 and is mounted on the support device 12 by means of bolts 68 (FIG. 2) to maintain the end of the coaxial cable 10 in position on the device 12.

The high-power coaxial cable of the invention has been tested at 450 watts average power at X-band for 2 hours without any degradation of performance due to the generation of heat and no sign of failure. On the other hand, a conventional hermeticallysealed silicon dioxide coaxial cable was tested at 300 watts average power at X-band and became inoperative after 2 minutes of operation.

From the foregoing it may be seen that the invention provides an efficient coaxial cable capable of operating at high power at X-band frequencies. The cable utilizes a relatively large, low-loss, center conductor and novel supporting insulator fittings therefor. The use of such fittings permits the provision of a sharp right angle turn in the cable without substantial impedance mismatch. The employment of press-fit assemblies, as described above, renders the structure readily assembled and inexpensive.

Although the present invention has been shown and described with reference to a particular embodiment, nevertheless, various changes and modifications which are obvious to a person skilled in the art to which the invention pertains are deemed to lie within the spirit, scope, and contemplation of the invention.

What is claimed is:

1. A high-power coaxial cable comprising:

an elongated inner conductor having an approximately 90° bend near one end and a reduced diameter portion at the other end;

a tubular outer conductor coaxially disposed about and spaced from said inner conductor such that a predetermined characteristic impedance is provided;

a first insulating fitting defining an approximately 90° bend and a center hole therethrough for receiving said approximately 90° bend of said inner conductor such that said one end of said inner conductor protrudes beyond said first insulating fitting, said first insulating fitting further defining a plurality of longitudinal holes therethrough radially outwardly from said center hole;

an electrically conductive sleeve for receiving said one end of said inner conductor;

a mounting block disposed about said first insulating fitting, said electrically conductive sleeve and one end of said outer conductor each being press-fit into opposite ends of said mounting block;

a second insulating fitting defining an axial hole for receiving said reduced diameter portion of said inner conductor; and a housing coaxially disposed about the end region of said outer conductor surrounding said second insulating fitting and said reduced diameter portion of said inner conductor.

2. A coaxial cable according to claim 1 wherein said first insulating fitting is formed in two like sections joined at right angles to one another along an interface disposed at an angle of substantially 45°.

3. A coaxial cable according to claim 1 and further including a snap ring disposed about said outer conductor to maintain said housing in locked position about said outer conductor.

* * * * *